United States Patent [19]

Turnquist et al.

[11] 4,404,891

[45] Sep. 20, 1983

[54] BRAKE VALVE FOR A HYDRAULICALLY POWERED WINCH

[75] Inventors: Edwin W. Turnquist; Rick J. Bentley, both of Tulsa, Okla.

[73] Assignee: Paccar Inc., Bellevue, Wash.

[21] Appl. No.: 179,186

[22] Filed: Aug. 18, 1980

[51] Int. Cl.[3] ..... F15B 15/26

[52] U.S. Cl. ..... 91/45; 91/420; 137/514.7; 254/361; 254/377

[58] Field of Search ..... 91/420, 421, 433, 41, 91/45; 137/87, 514.7, 514.3, 514.5; 60/420, 435; 92/8, 28; 251/48, 63, 63.5, 47, 50; 254/361, 377

[56] References Cited

U.S. PATENT DOCUMENTS

| | | | |
|---|---|---|---|
| 3,022,040 | 2/1962 | Miller | 251/63 |
| 3,086,551 | 4/1963 | Gordon | 137/514.5 |
| 3,485,474 | 12/1969 | Baumann . | |
| 4,127,144 | 11/1978 | Turner . | |
| 4,172,582 | 10/1979 | Bobnar | 91/420 |
| 4,183,375 | 1/1980 | Vick . | |
| 4,244,275 | 1/1981 | Smilges | 91/420 |

*Primary Examiner*—Martin P. Schwadron
*Assistant Examiner*—Richard L. Klein
*Attorney, Agent, or Firm*—Seed, Berry, Vernon & Baynham

[57] ABSTRACT

An improved brake valve for a hydraulically powered winch which has one flow path permitting the relatively unrestricted flow of hydraulic fluid through the valve when the winch is being used to raise a load and a second flow path in which the flow of fluid is controlled in response to the pressure of fluid at the motor inlet when the winch is being used to lower a load. Of particular significance are a fixed area orifice, an annular restrictive passageway and a variable area orifice which cooperate to distribute the pressure drop in the control circuit so as to reduce the sensitivity of the valve to pressure fluctuations in the hydraulic motor circuit. Also of significance are seals used on the spool and damper piston to retard the movement of the spool and to produce a desirable hysteresis effect in its response to pilot pressure.

9 Claims, 7 Drawing Figures

BRAKE VALVE FOR A HYDRAULICALLY POWERED WINCH

BACKGROUND OF THE INVENTION

This invention generally relates to flow control valves and more particularly to a brake valve for a hydraulically driven winch used to control the flow of hydraulic fluid out of the winch motor when it is being used to lower a load. This valve is particularly suited for use with a hydraulically driven high speed winch similar to those currently used on mobile cranes. It is designed to act in conjunction with the hydraulic winch motor, winch brake, overrunning clutch and gear train to provide precise load control under varying load conditions and hydraulic oil temperatures.

Brake valves are a special type of flow control valve and are generally well known in the art. In the past, these valves were typically pilot operated poppet type counter balance valves in which the poppet had a tapered end which fitted into a mating tapered seat. A pilot circuit was used to transmit pressure from the motor inlet to a pilot piston connected to the poppet. One undesirable characteristic of such valves was that a relatively small movement of the poppet would produce a relatively large variation in oil flow rate through the valves, resulting in stability problems during load lowering operations. In more recent brake valves the poppet has been replaced with a spool and the flow is required to pass through more than one orifice to reduce the sensitivity of the valve to pressure fluctuations in the motor control circuit.

In spite of these improvements, stability problems with such valves still persist. Typically, these problems arise when the winch control valve is moved too quickly into a full open position to lower a load and are particularly noticeable when the load is light. Upon a sudden movement of the control valve, the winch brake is released, fluid pressure rises rapidly in the pilot circuit, and the control spool is moved very quickly into a full open position. In this position the spool permits a sudden surge of fluid to pass through the motor, accelerating it to maximum r.p.m., causing the cable to go slack and permitting the load to fall free. When the motor is momentarily unloaded in this manner while running at high speed, fluid pressure at the motor inlet and in the pilot circuit drops quickly, causing the spool to close and slow the motor down abruptly. When the slack is gone from the cable, the fall of the load is arrested, often violently, and the tension on the cable increases suddenly. Subsequently, motor inlet and pilot pressures rise again, and this entire sequence of events is repeated. Often, the only way the operator can bring the system under control is to stop the winch. It has also been found that stability problems of this type are more likely to occur when the hydraulic oil is hot.

Accordingly, it is a primary object of this invention to provide for an improved brake valve for hydraulically driven winches which will exhibit better stability characteristics and less sensitivity to fluid operating temperatures during load lowering operations than those valves currently known in the art.

SUMMARY OF THE INVENTION

This invention can be most broadly summarized as an improved brake valve for a hydraulically driven winch or the like which has a control section to control the flow of fluid out of the hydraulic winch motor when the winch is being used to lower a load and a bypass section which permits the relatively unrestricted flow of fluid through the valve when the winch is being used to raise a load. This novel valve includes a housing having a plurality of cavities and passageways, a check valve permitting the flow of hydraulic fluid through the valve in one direction when the winch is being used to raise a load, a spool disposed for reciprocating motion within a spool bore in the housing, means responsive to fluid pressure at the motor inlet for urging the spool into an open position and means for biasing the spool toward a closed position. The valve also includes a fixed area orifice for metering the flow of fluid into the spool bore when the winch is being used to lower a load, an annular restrictive passageway formed between the spool and the spool bore, a variable area orifice formed by the spool and an orifice cavity in the housing, and friction producing means disposed between the spool and the spool bore for sealing the bore and for retarding the movement of the spool, tending to reduce the sensitivity of the valve to transient pressure changes in the hydraulic motor system.

In accordance with a more detailed aspect of this invention, the cross-sectional areas of the fixed area orifice, the annular restrictive passageway and the maximum cross-sectional area of the variable area orifice are equal.

In accordance with another more detailed aspect of this invention, the means for sealing the spool and retarding its motion include an o-ring encircling the spool and recessed in a groove therein.

DESCRIPTION OF PREFERRED EMBODIMENT

Figure 1:
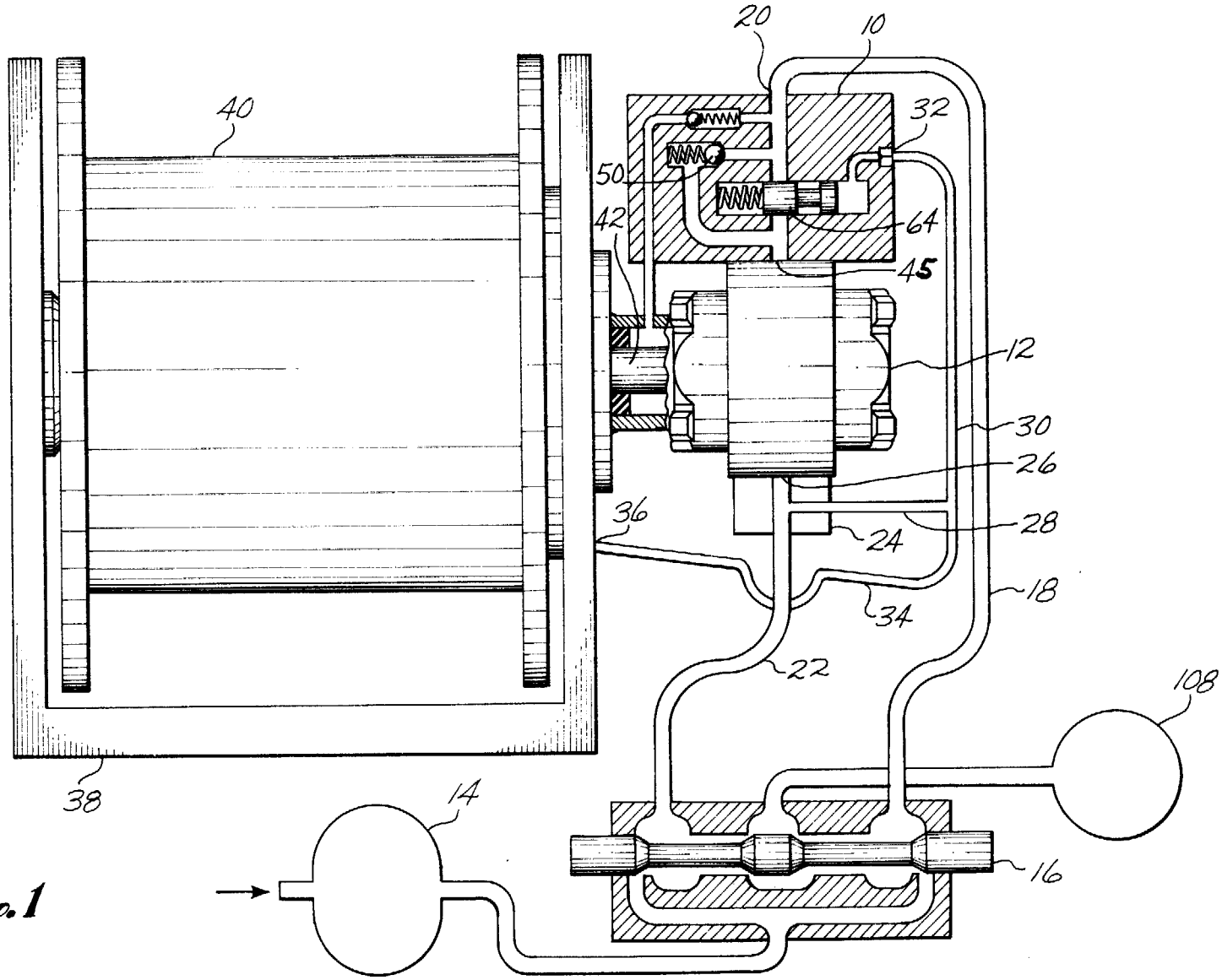
FIG. 1 is a schematic illustration of a brake valve constructed in accordance with this invention and installed on a typical hydraulically driven winch.
Figure 4:
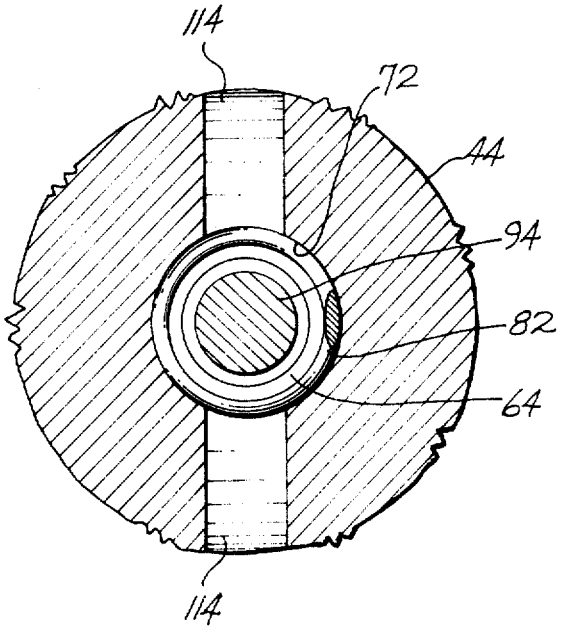
FIG. 4 is a partial sectional view taken at 4—4 of FIG. 2.

The novel features believed characteristic of this invention have been set forth in the appended claims, but the invention itself may be best understood and its various objects and advantages best appreciated by reference to the detailed description below in connection with the accompanying drawings. In FIG. 1 of those drawings, one embodiment of the present invention is shown schematically in a typical installation on a hydraulically driven winch. The brake valve, generally designated by the numeral 10, is attached to one port of hydraulic motor 12 which is preferably of the spur gear type. High pressure hydraulic fluid is supplied to the motor by pump 14 through control valve 16. One control port of the control valve is connected by hydraulic line 18 to inlet port 20 of the brake valve and the other is connected by hydraulic line 22 and manifold 24 to inlet port 26 of the motor. From this manifold, pressurized fluid is supplied through hydraulic lines 28 and 30 to pilot port 32 of the brake valve and through line 34 to release port 36 of the static brake. The winch itself, which is known in the art and generally designated by numeral 38, has a cable drum 40 which is connected to motor 12 by shaft 42 through an overrunning clutch, a multiple disc brake and a set of planetary reduction gears which are not shown in detail in this view.

The winch is equipped with a spring applied hydraulically released multiple disc type brake located inside the cable drum. When it is engaged, it locks the outer part of the overrunning clutch assembly to the winch housing. The inner part of the overrunning clutch is considered to be a part of the power train and is located between the motor and the first planetary gear reduction unit. The overrunning clutch has an inner and outer part and is designed so that the inner part can be rotated freely in one direction relative to the outer part, but becomes locked to the outer part when rotation in the opposite sense is attempted. During all winching operations, the power train which includes the motor and the drum is constantly engaged.

Figure 2:
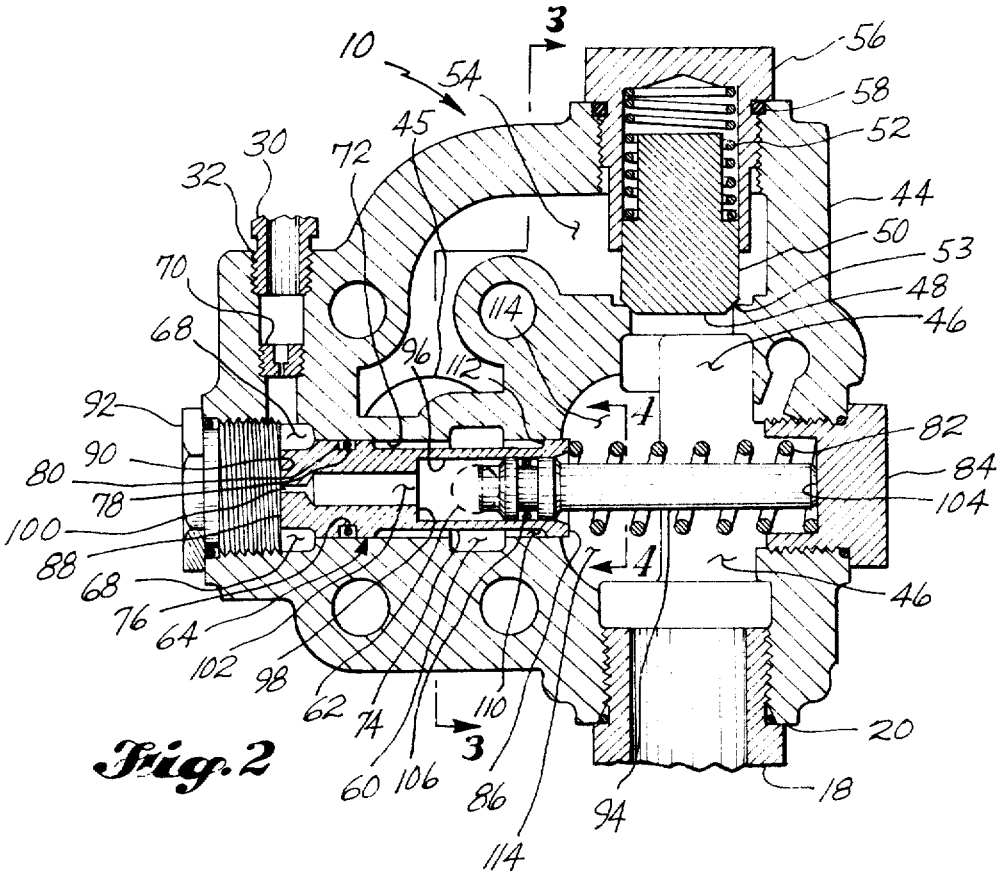
FIG. 2 is a cross-sectional view of one embodiment of the present invention.
Figure 3:
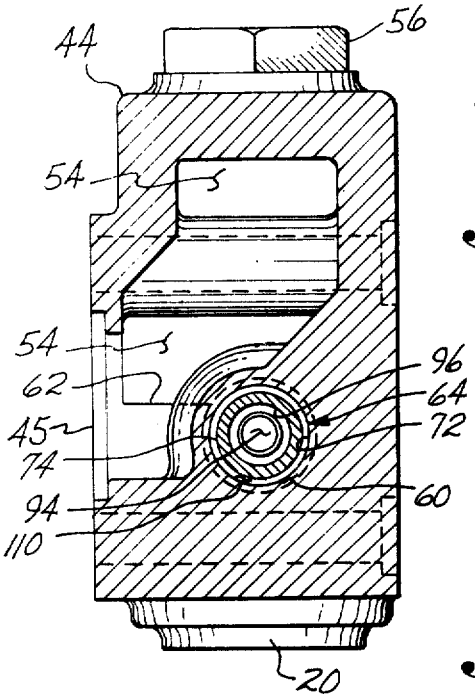
FIG. 3 is a sectional view taken at 3—3 of FIG. 2.

Referring now to FIGS. 2 and 3 in which the valve is shown in greater detail, it can be seen that valve body 44, which is preferably a casting, has two fluid ports 20 and 45. When the winch is being used to raise a load, high pressure fluid passes from hydraulic line 18 through port 20 into cavity 46, where it acts on head 48 of check valve 50. When the upward force on the head exceeds the relatively small amount necessary to compress spring 52, the valve opens, permitting fluid to pass by seat 53 into cavity 54. Spring 52 is retained in the housing by retaining plug 56 which is sealed by o-ring seal 58. After flowing into cavity 54, the fluid passes through port 45 into motor 12.

When the winch is being used to lower a load, fluid passing out of the motor enters the brake valve through port 45 into cavity 54, but is blocked from entering cavity 46 by check valve 50. It also enters annular cavity 60 through orifice 62, but is blocked from reaching cavity 46 by spool 64 when it is closed as shown. So long as the spool remains closed, fluid from the motor is prevented from passing into line 18 by the brake valve.

Fluid pressure in manifold 24 is transmitted through pilot line 30 to pilot port 32 and to annular pilot cavity 68. Orifice plug 70 is placed in the pilot port as shown to help damp out any flow fluctuations which might occur in the pilot port. Spool 64 which is generally cylindrical in shape is mounted for reciprocal movement in spool bore 72 in the housing. Recess 74 and seal recess 76 are machined in its outer surface. Fluid is prevented from passing by the piston from pilot cavity 68 to cavity 60 by o-ring seal 78 and back-up ring 80 which are located in seal recess 76 as shown. Spring 82 which is retained in the housing by spring retainer 84 presses against base 86 of the spool, biasing it toward a closed position. In that position, head 88 of the spool rests against surface 90 of stop plug 92.

Damper piston 94 is disposed for reciprocal motion in damper piston bore 96 in the spool. Motion of the damper piston in one direction is limited by spring retainer 84 and in the other by shoulder 98 of the damper piston bore. The purpose of the damper piston is to damp the motion of the spool as it moves toward an open position (to the right in FIG. 2). Before the spool opens, increasing fluid pressure in pilot port 32 and pilot cavity 68 will be transmitted through orifice 100 in the head of the spool to damper piston cavity 102, forcing the damper piston to bottom against inner surface 104 of spring retainer 84. As the spool opens, the fluid in cavity 102 will be forced through orifice 100 thus resisting the motion of the spool. Seal 106, preferably an o-ring, prevents fluid from passing by the damper piston into cavity 46. It has been found that the use of such a seal on the damper piston significantly improves its damping capabilities, particularly when the hydraulic fluid is hot. In some presently known brake valves having damper pistons without seals, it has been found that as the oil temperature rises, significant amounts of oil bypass the damper piston causing it to become relatively ineffective.

An important aspect of this invention is that when the spool 64 is open, fluid moving through the valve is forced to pass through two orifices and a restrictive passageway. Accordingly, the pressure drop through the valve is distributed across all of these restrictions rather than being concentrated at a single orifice as occurs in many of the valves found in the prior art. In passing through the valve, fluid must first flow from cavity 54 to cavity 60 through fixed circular orifice 62. Next the fluid is stored to pass through annular passageway 110 which is created between recess 74 in the spool and spool bore 72. In the preferred embodiment, the cross-sectional areas of orifice 62 and passageway 110 are equal and will result in approximately equal pressure drops in the fluid. The second orifice through which the fluid must flow is formed by a pair of nearly rectangular openings located on opposing sides of the spool. The openings are bounded by shoulder 112 of recess 74 and the edges of cavity 114 at its intersection with spool bore 72. This orifice opens as shoulder 112 enters cavity 114 and increases linearly in size as the spool continues to move to the right. In the preferred embodiment the total maximum area of this pair of openings is equal to the areas of each of orifice 62 and passageway 110 when the spool is fully open. Accordingly, when fluid is flowing at the same rate through all three restrictions, the pressure drop across each is approximately equal, and only about one-third of the total pressure drop across the valve occurs across the variable orifice. This particular feature reduces the sensitivity of the valve to pressure fluctuations in the motor circuit and thereby contributes significantly to the stability of the valve.

Figure 5:
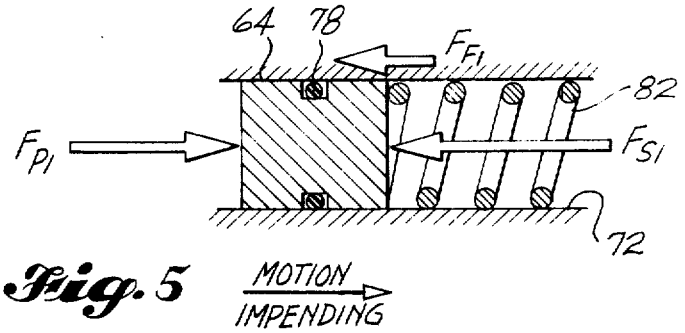
FIGS. 5 and 6 schematically illustrate certain forces acting on the spool of the embodiment of FIG. 2 when the valve is in operation.
Figure 6:
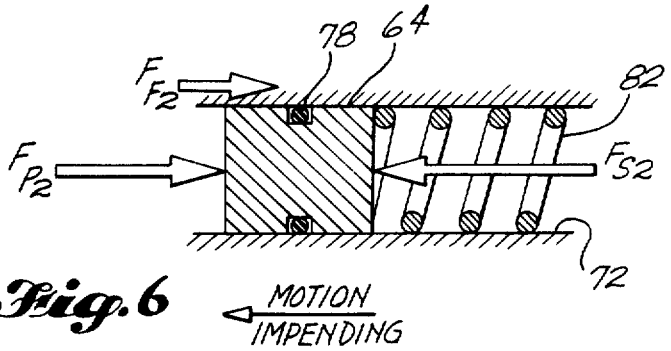
Figure 7:
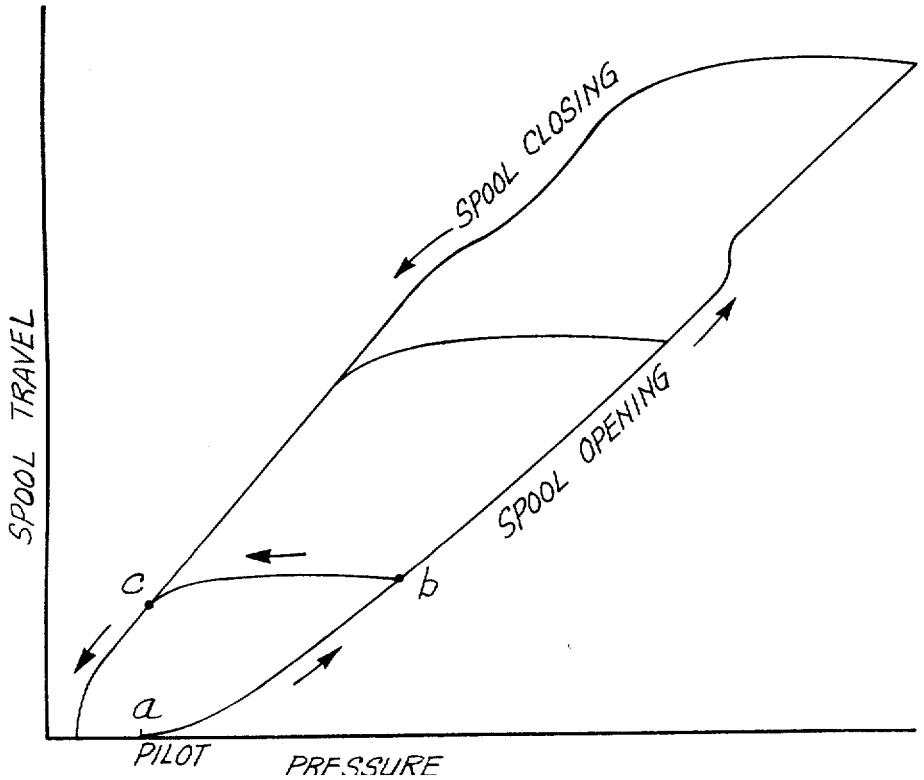
FIG. 7 is a graph illustrating the effect of the spool seal on the response of the spool of FIG. 2 to pilot pressure.

FIGS. 5, 6 and 7 schematically illustrate the hysteresis effect caused by seal 78 on the spool. Referring to FIG. 5 which represents the spool in the open position, but with motion impending to the right, Fp1 is the net fluid force acting on the spool due to pilot pressure, system back pressure and flow forces. Fp1 is exactly balanced by the sum of the spring force Fs1 and friction force Ff1. If the pilot pressure is decreased, thereby decreasing Fp1, until motion impends to the left, the forces will be as shown in FIG. 6. Since the spool has not moved, Fs2=Fs1 and Ff2=Ff1. Because static friction forces Ff1 and Ff2 are equal in magnitude but opposite in direction, the pilot force can fluctuate by an amount equal to twice the absolute value of the static friction force without causing the spool to move from an equilibrium position. As a result, the sensitivity of the brake valve to pressure fluctuations in the motor circuit is reduced and its stability is improved. FIG. 7 is a non-dimensional graph illustrating the effect of the friction of the spool seal. As pilot pressure is increased, the spool does not move until it reaches point "a" on the graph where it is sufficient to overcome the spring force, fluid force and static friction of the seal. As the pressure is increased beyond that point, the spool begins to open. If the pressure is increased to point "b" on the curve and then decreased, the spool does not follow curve b-a but instead unloads along curve b-c. In other words, as the pressure is decreased, the spool does not begin to close until the pilot pressure approaches the value at point "c". As the graph shows, this behavior is repeated as the spool is loaded and unloaded at higher pressures.

The preceding paragraph is intended to assist the reader in understanding the hysteresis effect of the seal without presenting a rigorous analysis. Accordingly, the effect of the damper piston and its o-ring which further enhance the hysteresis effect have been ignored. Also ignored are subtleties such as the effect of changing fluid pressure on the friction forces Ff1 and Ff2.

In operation, when the winch operator moves the control valve handle to raise a load, oil directed to the brake valve through line 18 enters port 20, raises check valve 50 off its seat and flows to the motor. During this operation, the fluid pressure in manifold 24 remains relatively low, so the winch brake remains engaged and spool 64 remains in a closed position. The overrunning clutch in the winch is positioned in such a way that its inner part will turn freely relative to the outer part when the motor rotates in the direction to raise a load. When the fluid pressure at port 45 rises to the point where the motor can overcome the resistance of the winch and the load, the motor will begin to turn and the load will be raised. The rate of flow to the motor and consequently the speed of the motor and the load will be determined by the position of control valve 16 within the "raise" portion of its travel.

When control valve 16 is returned to the neutral position, both motor ports are connected through the control valve to tank 108 and the pressure at the motor inlet drops to zero. At this point, the load will stop and tend to turn the winch in the reverse direction. The load cannot drive the power train backwards, however, because the inner part of the overriding clutch locks itself to the outer part when rotation is attempted in this direction and the outer part is locked to the winch housing by the winch brake. The load therefore is supported by the winch brake when the directional control valve is in neutral.

When control valve 16 is moved into the "lower" position, oil is directed to the motor through line 22 and manifold 24. The motor does not begin to turn immediately, however, because the winch brake is engaged. The brake release system is designed so that the brake will completely release before spool 64 begins to open. When the fluid pressure is high enough to release only the winch brake, the load begins to turn the motor. Were it not for internal leakage, the motor would not turn even after the brake is released because both fluid passageways through the brake valve are closed. One is blocked by spool 64 and the other by check valve 50. Because internal leakage in the motor does not occur, however, the motor turns very slowly when the brake is released, permitting the operator to lower the load slowly and position it accurately. It is this internal leakage that makes it necessary to equip the winch with a brake because otherwise the load would drift slowly downward once the control valve was moved to a neutral position.

When fluid pressure in manifold 24 and pilot line 30 increase to the point where spool 64 begins to open, fluid is permitted to flow out of the motor and through the brake valve. The motor begins to rotate more rapidly and the load moves downward faster. As the load accelerates, fluid pressure in manifold 24 decreases because the motor is now acting as a pump. Sensing this decrease in pressure, spool 64 begins to close, reducing the flow out of the motor, slowing the motor and the descent rate of the load. As this occurs, pressure in manifold 24 will begin to increase again, causing the spool to open and the motor speed to increase. If control valve 16 is held in a fixed position, spool 64 will quickly stabilize in a position where the forces acting on it from spring 82, the fluid in pilot cavity 68, the fluid in cavity 46, flow through the variable orifice and friction are balanced and the load will be lowered at a constant, controlled rate of descent.

Accordingly, it can be seen that the present invention provides for an improved brake valve for hydraulically driven winches which incorporates many novel features and offers significant advantages over the prior art. Although only one specific embodiment of this invention has been illustrated and described, it is to be understood that obvious modifications and changes may be made in it without departing from the true scope and spirit of this invention.

We claim:

1. An improved brake valve for a winch or the like having a drum powered by a rotary hydraulic motor and having a drum brake, comprising:

said motor having a drum lowering inlet for receiving pressurized fluid for lowering a load when the drum brake is released, said drum brake having a brake release port for receiving pressurized fluid to release the drum brake;

a housing having a plurality of cavities and passageways therein;

a check valve permitting the flow of hydraulic fluid through the valve in one direction when the winch is being used to raise a load and means for biasing the check valve toward a closed position;

a fixed area orifice for metering the flow of fluid into a spool bore in the housing when the winch is being used to lower a load;

a spool disposed for reciprocating motion between open and closed positions within said bore and means for biasing said spool toward the closed position, said spool cooperating with said spool bore to provide an annular restrictive passageway therebetween and said spool further cooperating with an orifice cavity in said housing to provide a variable area orifice, said fixed area orifice creating a pressure drop upstream of said variable area orifice;

means coupling the drum lowering inlet, the brake release port and the spool of said brake valve for simultaneously receiving pressurized fluid for lowering the load, releasing the drum drake and for urging said spool into an open position;

a damper piston disposed for reciprocating motion within a damper piston bore in said spool and tending to retard the movement of said spool toward an open position, a flow-restricting, damping orifice communicating with said damper piston bore, said damper piston blocking passage of fluid movement out of said damper piston bore but allowing fluid to pass out of said damping orifice to damp movement of said spool;

and radially expandible friction producing means disposed between said spool and said spool bore and engageable therewith for retarding the movement of said spool, said friction producing means tending to reduce the sensitivity of said valve to transient pressure changes.

2. The brake valve of claim 1 wherein the cross-sectional areas of said fixed area orifice and said restrictive passageway are equal.

3. The brake valve of claim 1 wherein the cross-sectional areas of said fixed area orifice said restrictive passageway and the maximum cross-sectional area of said variable area orifice are equal.

4. The brake valve of claim 1 wherein said friction producing means includes an o-ring seal encircling said spool and recessed in a seal recess therein.

5. The brake valve of claim 1, further including means for sealing disposed between said damper piston and said damper piston bore.

6. The brake valve of claim 1 wherein said responsive means includes a pilot circuit providing communication between said motor inlet and said spool bore, said system including a pilot port in said housing.

7. The brake valve of claim 1 wherein said spool has a closed and a fully opened position and wherein the cross-sectional area of said variable orifice varies linearly as said spool is moved between said two positions.

8. An improved brake valve for a winch or the like having a drum powered by a rotary hydraulic motor and having a drum brake for restricting winch drum rotation, comprising:

said motor having a drum lowering inlet for receiving pressurized fluid for lowering a load when the drum brake is released, said drum brake having a brake release port for receiving pressurized fluid to release the drum brake;

a housing having a plurality of cavities and passageways therein and a spool bore;

a check valve permitting the flow of hydraulic fluid through the valve in one direction when the winch is being used to raise a load and means for biasing the check valve toward a closed position;

a spool disposed for reciprocating motion within said spool bore and means for biasing said spool toward a closed position, said spool cooperating with an orifice cavity in said housing to provide a variable area orifice;

at least one fixed area orifice upstream of said variable area orifice;

means coupling the drum lowering inlet, the brake release port and the spool of said brake valve for simultaneously receiving pressurized fluid for lowering the load, releasing the drum brake and for urging said spool into an open position;

a damper piston disposed for reciprocating motion within a damper piston bore in said spool and tending to retard the movement of said spool toward an open position, a flow restricting, damping orifice communicating with said damper piston bore, said damper piston blocking passage of fluid movement out of said damper piston bore but allowing fluid to pass out of said damping orifice to damp movement of said spool; and radially expandible friction means engageable between said spool bore and said spool for impeding axial movement of the spool in the bore for stabilizing the spool.

9. An improved brake valve for a winch or the like having a drum powered by a hydraulic rotary motor and having a drum brake for restricting rotation of the drum, comprising:

said motor having a drum lowering inlet for receiving pressurized fluid directed to said winch brake when said brake is released for lowering a load, said drum brake having a brake release port for receiving pressurized fluid to release the drum brake;

a housing having a plurality of cavities and passageways therein;

a check valve permitting the flow of hydraulic fluid through the valve in one direction when the winch is being used to raise a load and means for biasing the check valve toward a closed position;

orifice means for metering the flow of fluid through the valve when the winch is being used to lower a load;

a spool disposed for reciprocating motion between open and closed positions within said bore and means for biasing said spool toward the closed position, said spool cooperating with said spool bore to provide an annular restrictive passageway therebetween and said spool further cooperating with an orifice cavity in said housing to provide a variable area orifice, said fixed area orifice creating a pressure drop upstream of said variable area orifice;

means coupling the drum lowering inlet, the brake release port and the spool of said brake valve for simultaneously receiving pressurized fluid for lowering the load, releasing the drum drake and for urging said spool into an open position;

a damper piston disposed for reciprocating motion within a damper piston bore in said spool and tending to retard the movement of said spool toward an open position, a flow-restricting, damping orifice communicating with said damper piston bore, said damper piston blocking passage of fluid movement out of said damper piston bore but allowing fluid to pass out of said damping orifice to damp movement of said spool; and radially expandible friction producing means disposed between said spool and said spool bore and engageable therewith for retarding the movement of said spool, said friction producing means tending to reduce the sensitivity of said valve to transient pressure changes.

* * * * *